US005873307A

United States Patent [19]

Tenfelde et al.

[11] Patent Number: 5,873,307

[45] Date of Patent: Feb. 23, 1999

[54] CONTROL SYSTEM FOR A PRINTING MACHINE

[75] Inventors: Johannes Tenfelde, Rodgau; Michael Dotzert, Friedrichsdorf, both of Germany

[73] Assignee: MAN Roland Druckmaschinen AG, Germany

[21] Appl. No.: 659,718

[22] Filed: Jun. 6, 1996

[30] Foreign Application Priority Data

Jun. 8, 1995 [DE] Germany ..... 195 20 919.2

[51] Int. Cl.[6] ..... B41F 13/24

[52] U.S. Cl. ..... 101/248; 101/DIG. 36; 377/17; 377/28

[58] Field of Search ..... 101/248, DIG. 36, 101/184; 377/17, 28

[56] References Cited

U.S. PATENT DOCUMENTS

| | | | |
|---|---|---|---|
| 4,581,993 | 4/1986 | Schöneberger | 101/248 |
| 4,621,256 | 11/1986 | Rusk | 101/248 |
| 4,661,919 | 4/1987 | Bushmann et al. | 101/184 |
| 4,665,498 | 5/1987 | Buschmann et al. . | |
| 4,669,050 | 5/1987 | Buschmann et al. | 101/184 |
| 4,951,567 | 8/1990 | Rodi et al. . | |
| 5,058,145 | 10/1991 | Hauck et al. . | |
| 5,101,474 | 3/1992 | Schlegel et al. . | |
| 5,309,834 | 5/1994 | Koch . | |
| 5,386,772 | 2/1995 | Tolle et al. . | |
| 5,656,909 | 8/1997 | Gotz et al. | 101/DIG. 36 |

FOREIGN PATENT DOCUMENTS

| | | |
|---|---|---|
| 0 543 281 A1 | 11/1992 | European Pat. Off. . |
| 3614979 | 11/1987 | Germany . |
| 3 815 534 A1 | 11/1989 | Germany . |
| 38 36 310 A1 | 4/1990 | Germany . |
| 38 39 248 A1 | 5/1990 | Germany . |
| 34 06 924 C2 | 10/1992 | Germany . |
| 42 14 394 A1 | 11/1993 | Germany . |
| 177646 | 8/1987 | Japan . |
| 101221 | 4/1992 | Japan . |

OTHER PUBLICATIONS

Blome et al., "Comparison of Efficiencies of 'Fieldbus' Protocols," *Elektronik,* 43(1), 48–50 (1994), Abstract.

*Primary Examiner*—Eugene H. Eickholt
*Attorney, Agent, or Firm*—Leydig, Voit & Mayer, Ltd.

[57] ABSTRACT

The present invention relates to a control means for a printing machine, in particular a sheet-fed offset printing machine, having a plurality of units, such as feeders, printing units, varnishing and coating devices, deliverers, folding apparatus and the like, each unit being assigned a station having at least one computer and these stations being connected to one another via a first bus. It is intended to ensure that the switching processes which are to be carried out in the individual units of the printing machine at specific, predetermined angle positions can proceed exactly, even at the highest machine speeds. According to the present invention, for this purpose it is proposed that, in addition to the first bus, via which the stations exchange signals with one another, a second bus is provided, via which the individual stations may be fed with the angle position signals of a single-turn rotating angle encoder which is fitted on one unit of the printing machine. It is thus ensured that each station can carry out the switching processes which are a function of angle position in the associated unit.

12 Claims, 2 Drawing Sheets

CONTROL SYSTEM FOR A PRINTING MACHINE

BACKGROUND OF THE INVENTION

1. Field of the Invention

The present invention relates to a control system for a printing machine, and more particularly, to a decentralized control system utilizing a multiple bus communication structure for a sheet-fed offset printing machine.

2. Discussion of the Related Art

Currently utilized sheet-fed offset printing machines generally have a central control system for controlling the operation of the printing machines. The central control system typically comprises a programmable controller or PC-board controller. It is also known to divide the control of the printing machine by function. Thus, a first computer can be provided which permanently reads in the switching states or signals from actuators, operating keyboards or sensors, and a second computer can be used to control the main drive and those switching processes of the printing machine which relate to the rotation angle of moving machine parts. Rotation angle dependent switching functions include, for example, the throwing-on and the throwing-off of print, the throwing-on and the throwing-off of ink and damping solution applicator rollers, the blocking of the sheet inlet, the switching of the sheet feeder unit and the switching of specific functions in the deliverer unit. These switching processes are time critical, e.g., the throwing-on of the inked blanket cylinder onto the back-pressure cylinder carrying the sheet may only take place during the channel correspondence of the cylinder, that is to say when the first sheet to be printed is already lying on the back-pressure cylinder.

A disadvantage associated with the control system described above is that the control software or program for implementing the sequence of switching functions of the printing machine must exactly correspond to the configuration of the printing machine. In other words, any change in the configuration of the printing machine would necessitate reprogramming of the control system. For example, a sheet-fed printing machine having a different number of printing units thus necessitates different programming of the corresponding control system. This situation becomes significantly more complicated as a result of the fact that nowadays there is a distinct trend towards so called in-line finishing or further processing. In the case of sheet-fed offset printing machines there are often one or more varnishing devices or other coating units interposed after the last printing unit and before the deliverer unit. Since angular position dependent switching processes also have to be executed in these devices, these functions must also be undertaken by the central control system.

DE 3 815 534 A1 discloses a central control system of the type briefly outlined above, that has a system for detecting the position of moving machine parts. For this purpose, the signals from an incremental encoder mounted on a single-turn rotating shaft of the machine are evaluated. In this system, not only are the square-wave signals, phase-shifted by 90°, from the incremental encoder evaluated, but also the so called zero pulses which occur in each case at one complete single-turn machine revolution. A central control system having a system of this type exhibits the above mentioned disadvantages associated therewith. Instead of an incremental encoder, an absolute angle encoder can also be used for detecting the position of the moving machine parts. However, this alters nothing in the complexity of the control system which results if a printing machine is equipped with a varying number of units.

EP 0 543 281 A1 discloses a control system for rotary printing machines, in which part of the plant is assigned a computer representing the control system, and the computers in the individual parts of the plant are connected to one another via a bus system designated as a network for the purpose of signal exchange. As the linking interface between the individual computers, ARCNET by means of coax cable is proposed. How individual rotation angle dependent switching processes are to be executed is not described in this document.

DE 4 214 394 A1 discloses a rotary printing machine which has a number of individually driven cylinders as well as a separately driven folding apparatus. The individual drives of the cylinders and the drive regulators are comprised into printing position groups at will, in which arrangement from the folding apparatus a position reference is derived, and the governing of the printing position groups occurs through a superordinated pilot system. This state of the art system relates to a drive control for achieving synchronism in the case of several individual drives.

DE 3 406 924 C2 discloses a device for the generation of control signals for a printing machine in order, by means of these control signals, to trigger switching processes at different angle positions of the printing machine cylinders or the like. The described device includes an impulse-generating arrangement and of an impulse processing arrangement engaged on an outlet side, the outputs of which deliver the control signals with variant impulse sequences and lengths. The impulse-processing arrangement contains there at least one arrangement for rotation angle address generation, the outputs of which are formed by parallel outputs of a rotation angle increment counter, and a memory contructed as a PROM with which, on each of its outputs, independently timed control signals are suppliable from the other outputs.

DE 3 836 310 A1 discloses a process and an arrangement for the control of switching processes on a printing machine in which here, over a computer along with allocated angle encoder, the switching processes are executed in several units (feeder, discharger, printing mechanisms).

SUMMARY OF THE INVENTION

In accordance with one aspect, the present invention is directed to a control system for a printing machine having a plurality of functional units. The control system comprises a sensor operatively associated with one of the functional units for determining an angle of rotation of a single turn shaft in the functional unit and outputting a signal indicative of the angle of rotation, a plurality of control stations, each including a microprocessor based controller, for triggering switching processes in the functional units based upon the angle of rotation determined by the sensor, each of the control stations being operatively associated with one of the functional units, a first bus connecting the control stations, a central control computer and a printing machine main drive for bidirectional signal exchange therebetween, and a second bus connecting the control stations and the sensor for providing the sensor output to the control stations.

The control system of the present invention may be utilized for controlling the operation of printing machines, e.g., sheet-fed offset printing machines, that include a plurality of functional units, the number of which may change for a given application. For example, a particular printing machine may include a feeder unit, one or more printing units, one or more varnishing and coating units, a delivery unit, and a folding apparatus. The control system comprises a plurality of control stations, each having at least one computer, a central control computer, a sensor for determining printing machine cycles, and two bus systems interconnecting the various elements comprising the control system. The control system of the present invention facilitates accurate and high speed control of printing machine functions in addition to being highly reconfigurable by utilizing a number of control stations corresponding to the number of functional units comprising the printing machine and two bus systems dedicated to different functions.

According to the present invention, provision is made that, in addition to a bus interlinking the individual control stations, a second bus is provided via which the signals of the angle position of an angle encoder may be transmitted, this angle encoder being fitted on a single-turn rotating machine part of the printing machine. By means of the bus system transmitting these angle position values, each individual station receives the information about the current angle value. In the individual control stations, desired angle position values are stored corresponding to the events which may be transmitted via the bus, so that the individual stations can trigger the envisaged switching processes in the associated units. One example which may be mentioned here is the correctly sequenced throwing-off of the print in the case of a mis-sheet/crooked sheet and the disengagement of the feeder unit.

According to a development of the invention, provision can be made that, in one unit of the printing machine, an incremental angle encoder is arranged on a single-turn rotating machine part. The bus system provided in accordance with the invention comprises a number of lines via which the individual mutually phase-shifted incremental signals are transmitted. The bus system according to the invention has a further line via which, after each complete machine rotation, a so called zero pulse is transmitted. A bus system of this type ensures that it is possible to trigger in the individual stations even those switching processes which have to be executed after a specific number of single-turn machine rotations, starting from the event determined. Here, once more as an example, mention should be made of the correctly sequenced throwing-on or throwing-off of the printing unit cylinder, according to the paper run.

According to a further aspect of the present invention, provision can be made that, in one unit of the printing machine, an absolute angle encoder is fitted on a single-turn rotating machine part, the digital values corresponding to the angle position being able to be taken from the absolute angle encoder in a parallel or serial fashion. The bus system provided according to the invention is then designed as a parallel or serial bus system matched to the resolution of the absolute angle encoder. Provision is also made in the present invention, that, not only for angle values resolved within one machine revolution to be transmitted via the bus system but, in addition, signals which in each case correspond to one complete machine revolution.

In a previous paragraph it is explained that the zero pulse which can be supplied by the incremental or absolute angle encoder can be used for determining whole numbers of machine revolutions. However, in the case of incremental or absolute angle encoders it is also possible to define whole number machine rotations by summing the angle pulses or by means of a predetermined angle value of the absolute encoder.

As indicated above, the angle values of an angle encoder mounted on a single-turn rotating machine component are fed via the bus system according to the present invention to the individual control stations in the units. A single-turn rotating machine component of the printing machine should be understood, in particular, as the plate cylinder, the blanket cylinder, the single large back-pressure cylinder or, for example, a single-turn running feeder drum.

According to another aspect of the present invention, provision is made that the bus which is present in addition to the bus system transmitting the angle values is designed as an event-controlled, message-oriented communication system, that is to say as a bus system having a message-oriented protocol. Use is preferably made here of the CAN bus (Controller Area Network). By means of a bus designed in this way, it is possible that a control station which determines a specific event by means of sensors or other monitoring means transmits a message about this event over the CAN bus and the control stations in the associated units then trigger the envisaged angle-dependent switching processes. Mention should be made here, by way of example, of the determination of a mis-sheet/crooked sheet on the rest of the first printing unit or a sheet loss between the second and third printing units. The station which is associated with the respective unit and determines the event now sends via the bus system the message "mis-sheet" or "crooked sheet" or "sheet loss between printing units" to the remaining control station. In the event of a mis-sheet/crooked sheet, the station associated with the first printing unit then triggers the processes which are to be switched as a function of angle in the first printing unit (e.g. printing throw-off).

Depending on the desired angle position values stored in the remaining control stations for the message received, these stations now trigger the respective switching processes in the associated units (for example, correctly-sequenced printing throw-off in the printing units arranged after the first printing unit, as well as disengagement of the feeder).

BRIEF DESCRIPTION OF THE DRAWINGS

Exemplary embodiments of a control system for a printing machine in accordance with the present invention are described below with reference to the accompanying drawings in which.

DETAILED DESCRIPTION OF THE PREFERRED EMBODIMENTS

The exemplary control system of the present invention may be utilized for controlling the operation of printing machines, e.g., sheet-fed offset printing machines, that include a plurality of functional units, the number of which may change for a given application. For example, a particular printing machine may include a feeder unit, one or more printing units, one or more varnishing and coating units, a delivery unit, and a folding apparatus. The exemplary control system comprises a plurality of control stations, each having at least one computer, a central control computer, a sensor for determining printing machine cycles, i.e., the number of machine revolutions, and two bus systems interconnecting the various elements comprising the control system. The exemplary control system of the present invention facilitates accurate and high speed control of printing machine functions in addition to being highly reconfigurable by utilizing a number of control stations corresponding to the number of functional units comprising the printing machine and two bus systems dedicated to different functions. Essentially, the present invention relates to a system that controls and synchronizes all switching processes in each of the individual units, and one wherein it is not required to reconfigure any of the control functions as the number of units are changed.

Figure 1:
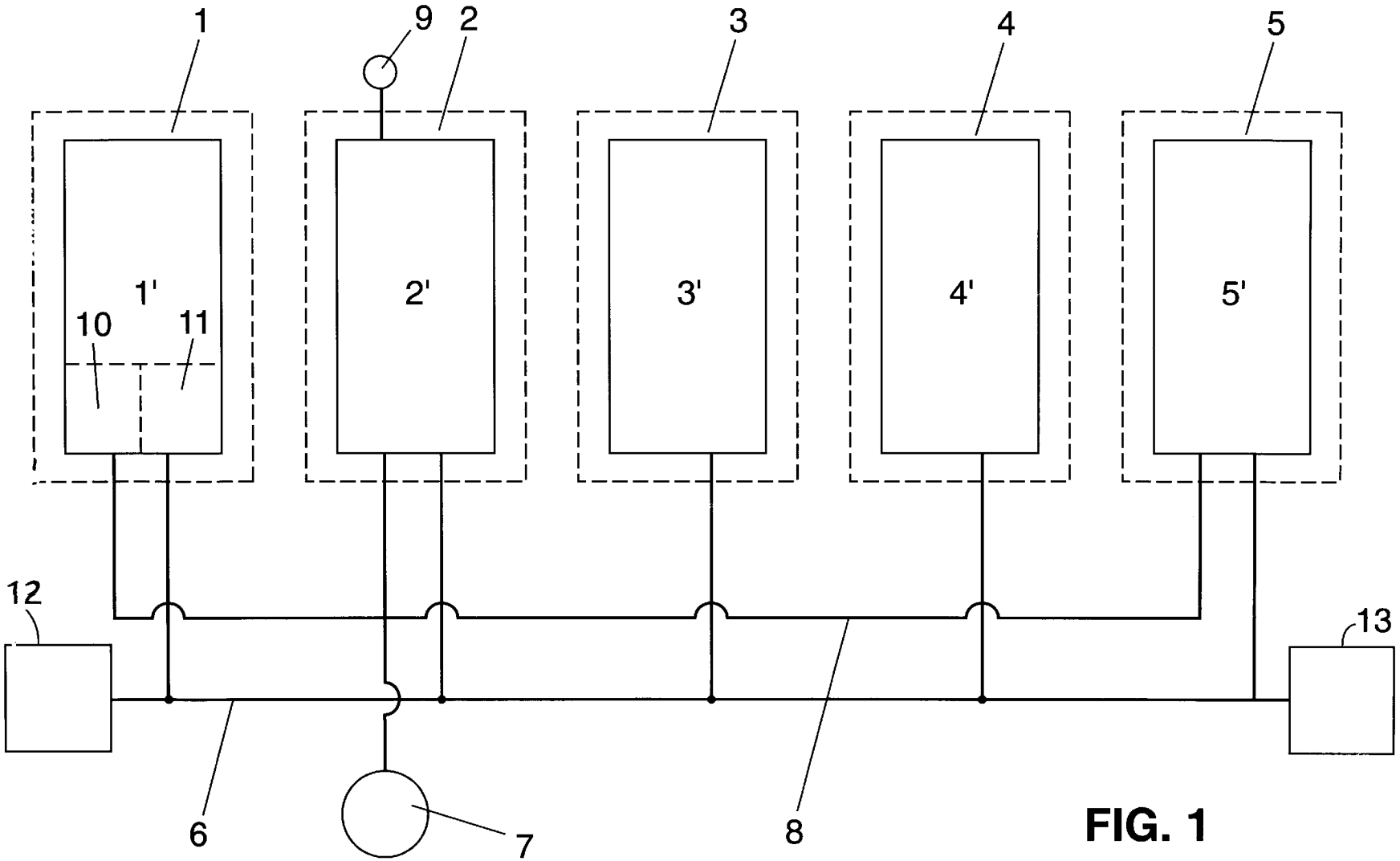
FIG. 1 is a partial block diagram representation of a sheet-fed offset printing machine.

FIG. 1 is a block diagram representation of a sheet-fed offset printing machine comprising a feeder unit 1, first and second offset printing units 2,3, a varnishing unit 4, and a delivery unit 5. Associated with each of the units 1,2,3,4, and 5 are control stations 1', 2', 3', 4' and 5', each of which includes at least one computer or microprocessor and associated memory. The control stations 1',2',3',4' and 5', use the microprocessors and associated memory as programmable controllers that implement known control functions that are programmed into memory for a given functional unit. The control stations 1',2',3',4' and 5' trigger and control the various switching functions in the particular units 1,2,3,4, and 5 via interface circuitry 10 and actuators 11. The interface circuitry 10 may include any suitable means for communication between a microprocessor and peripheral devices such as the actuators 11. The actuators 11 may include switches and relays. The interface circuitry 10 and actuators 11 are known in the art. For example, control station 1' controls all the switching functions of the feeder unit 1, e.g., the correctly phased switching on and switching off of the feeder unit 1, control stations 2', 3' and 4' control the throwing on and the throwing off of the various cylinders associated with the printing units 2 and 3 and the varnishing unit 4, and control station 5' controls all the switching functions associated with the delivery unit 5. The switching functions associated with the delivery unit 5 are synchronized with the sheet run such that automated stack change or sample sheet removal occurs at the proper time. The control station 2' in the first printing unit 2 is also connected to at least one sensor for the determination of the arrival of a sheet on the rest. The at least one sensor may comprise any suitable device or devices for the detection of sheets, including optical sensors. In FIG. 1, the at least one sensor is represented as a sheet monitor 9.

The individual control stations 1',2',3',4' and 5' are connected to one another via a first bus 6 for the purpose of a signal exchange. The first bus 6 may comprise any suitable means for signal exchange. For example, the first bus 6 may comprise an optical or electrical bus, and it may be a serial or parallel bus. In a preferred embodiment, the first bus 6 comprises a Controller Area Network (CAN) bus configured to carry messages in serial format. The CAN bus 6 is an electrical bus for serial communication and is known in the art as an event controlled, message-oriented communication system, that is to say a bus system having a message-oriented protocol. Via the first bus 6, the individual control stations 1',2',3',4' and 5' are also connected to a control desk computer 12, i.e., a central control computer and to the main drive 13 of the printing machine, so that data for presettings and the like can be forwarded to the individual computers comprising the control stations 1',2',3',4' and 5' from the control desk computer 12 and running commands from the control stations 1',2',3',4' and 5' can be forwarded to the main drive 13.

An angle encoder 7 may be utilized for determining printing machine cycles. The angle encoder 7 may be mounted to a single turn shaft in the first offset printing unit 2 to measure the angular position of the particular single turn shaft which may be utilized to determine the position of sheets in the printing machine. The angle encoder 7 may comprise an absolute angle encoder or an incremental angle encoder. Exemplary angle encoders are disclosed in U.S. Pat. No. 4,581,993, assigned to the same assignee as the present invention and incorporated by reference herein. The angle encoder 7 is connected directly to the control station 2' associated with the first offset printing unit 2, and is connected to the remaining control stations 1',3',4' and 5' via a second bus 8 and associated interface circuitry associated with the control stations 1',3',4' and 5'. Essentially, the angle encoder 7 monitors the angular position of the single turn shaft to which it is attached and transmits the monitored position to the other control stations 1',3',4' and 5' via the second bus 8. A single turn shaft or rotating machine component can be a plate cylinder, a blanket cylinder, a back pressure cylinder, a single turn feeder driven or any other similar component. The switching functions of the offset printing machine are linked to the angle measurement of the angle encoder 7 in a known manner. In other words, the switching functions throughout the printing machine may be synchronized by the angle measurements in one unit of the printing machine. In the individual control stations 1',2',3',4' and 5', desired angular positions corresponding to specific events may be stored in memory and when the desired angular position for a specific event is reached as determined by the angle encoder 7, the control stations 1',2',3',4' and 5' can trigger the desired switching processes in the associated units 1,2,3,4 and 5. For example, the correctly sequenced throwing-off of the print in the case of a mis-sheet or crooked sheet and the disengagement of the feeder unit 1.

The second bus 8 may comprise any suitable means for transmitting data relating to the angular position of the single turn shaft to which the angle encoder 7 is attached. For example, the second bus 8 may comprise an optical or electrical bus, and it may be a serial bus or parallel bus. The choice of bus may also depend on the type of angle encoder 7 utilized. For example, if an incremental angle encoder is utilized, the second bus 8 may comprise a number of individual lines to carry the two or more phase shifted output pulses of the encoder and a separate line for carrying a zero pulse signal which is output by the encoder after each complete machine revolution. Essentially, the second bus 8 is designed to match the type of angle encoder 7.

An example of the operation of the control system of the present invention is described below using the example of a so called mis-sheet. The term mis-sheet is to be understood as an absence of a sheet on the rest when the printing machine is running. In the case of such a mis-sheet, it is thus absolutely necessary that in the individual printing units 2,3 the blanket cylinder must be thrown off from the back-pressure cylinders in order to prevent inking of the back-pressure cylinders. The cylinder effecting the application of varnish in the varnishing unit 4 must also be thrown off. The throwing-off processes described have to be carried out in a sequential manner corresponding to the sheet run, in order that the sheets still running correctly into the machine are printed.

The control station 2' associated with the first offset printing unit 2 is connected to the sheet monitor 9 and continuously evaluates the signal from the sheet monitor 9 to determine the proper alignment of sheets to be printed. At a specific instant a mis-sheet is determined by the control station 2' via the sheet monitor 9, a program sequence stored in the memory of the control stations 1',2',3',4' and 5' is initiated, for example, in accordance with the program sequence. The program sequence may be the same or different for each of the functional units. In addition, the specific sequences may vary depending on the type of printing machine. Also stored in the memory of the control station 2' are angle values which correspond to those values at which the throwing off of the printing unit cylinder in printing unit 2 has to take place. The control station 2' now effects, at the correspondingly predetermined angle values, the blocking of the feeder and of the pregripper and then the throwing-off of the blanket cylinder from the back-pressure cylinder and the throwing-off with respect to the plate cylinder in the first printing unit 2.

At the instant at which the mis-sheet was determined by the control station 2', the control station 2' passes a signal corresponding to the event "mis-sheet in the first printing unit" to the first bus 6. Stored in the memories of the control stations 1',3',4' and 5' are likewise angle values at which switching measures to be undertaken in their corresponding units 1,3,4,5 can be carried out. After the control station 1' has received the event "mis-sheet in the first printing unit" via the first bus 6, the feeder unit 1 is switched off by the control station 1'. After a number of revolutions corresponding to the sheet run, the throwing-off of the print is initiated at the envisaged, stored angle values by means of the control stations 3',4',5' likewise receiving the message "mis-sheet in the first printing unit". For this purpose, the stations 1',2',3',4',5' evaluate both the angle signals within one revolution and the number of revolutions as a whole.

Although in the above described example, only the first printing unit 2 is described, the other switching processes in the individual units 1,3,4,5 are also initiated in accordance with the indicated sequence. It is important that the individual control stations 1',2',3',4' and 5' continuously read in the angle position values from the angle encoder 7 and a message corresponding to the event is transmitted via the second bus 8 from one of the control stations 1',2',3',4' and 5' to the remaining control stations 1',2',3',4' and 5' and, in the process, each of the control stations 1',2',3',4' and 5' automatically carries out the necessary switching processes in the associated units 1,2,3,4,5 by means of a comparison of the detected current angle values with those correspondingly stored. A further advantage of the continuous detection and evaluation of the angle position values in the individual control stations 1',2',3',4' and 5' lies, moreover, in the fact that the individual control stations 1',2',3',4' and 5' can also carry out angle dependent switching functions in the associated units, irrespective of the presence or receipt of a message/of an event, i.e., normal operation. Here, by way of example, mention should be made of the control of the oscillating movement of an ink feeder roller, the stepwise driving of a duct or roller, powdering matched to the sheet run by means of electronically controllable drives or other devices during the normal printing process. A decentralized control means, constructed in this manner according to the present invention, is therefore very advantageously structured in the case of time/critical functions.

Figure 2:
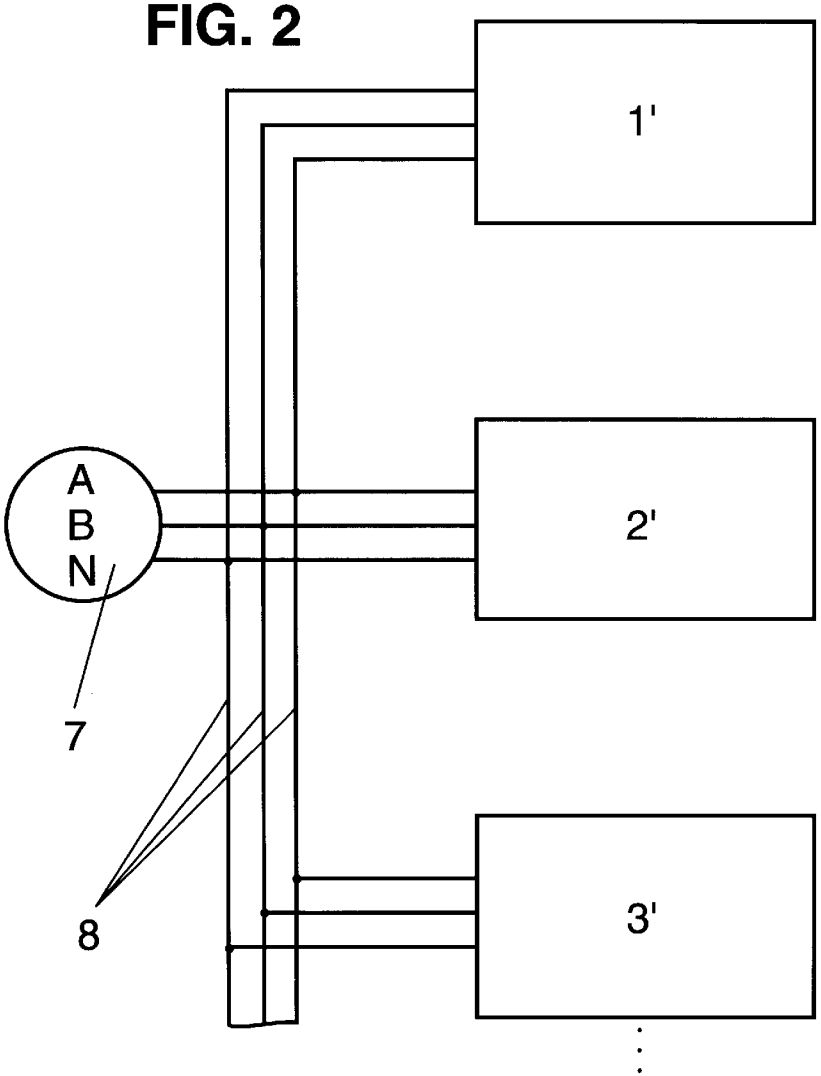
FIG. 2 is a block diagram representation of a first exemplary bus system coupling the components of a sheet-fed offset printing machine in accordance with the present invention.

FIG. 2 illustrates an exemplary embodiment of the present invention wherein the angle encoder 7 comprises an incremental angle encoder. The incremental angle encoder 7 is mounted in a single-turn shaft in the first offset printing unit 2 of the sheet-fed offset printing machine. Via a total of three lines, the incremental signals, mutually phase-shifted in each case by 90°, from the track A and B, and a so-called zero pulse are fed to the control station 2' of the first offset printing unit 2 on the track N. The second bus 8 provided according to the invention for transmitting the angle position values to the remaining control stations 1',3',4',5' likewise comprises three lines, so that here, too, the incremental signals of the tracks A and B and the single-turn zero pulses N may be transmitted.

Figure 3:
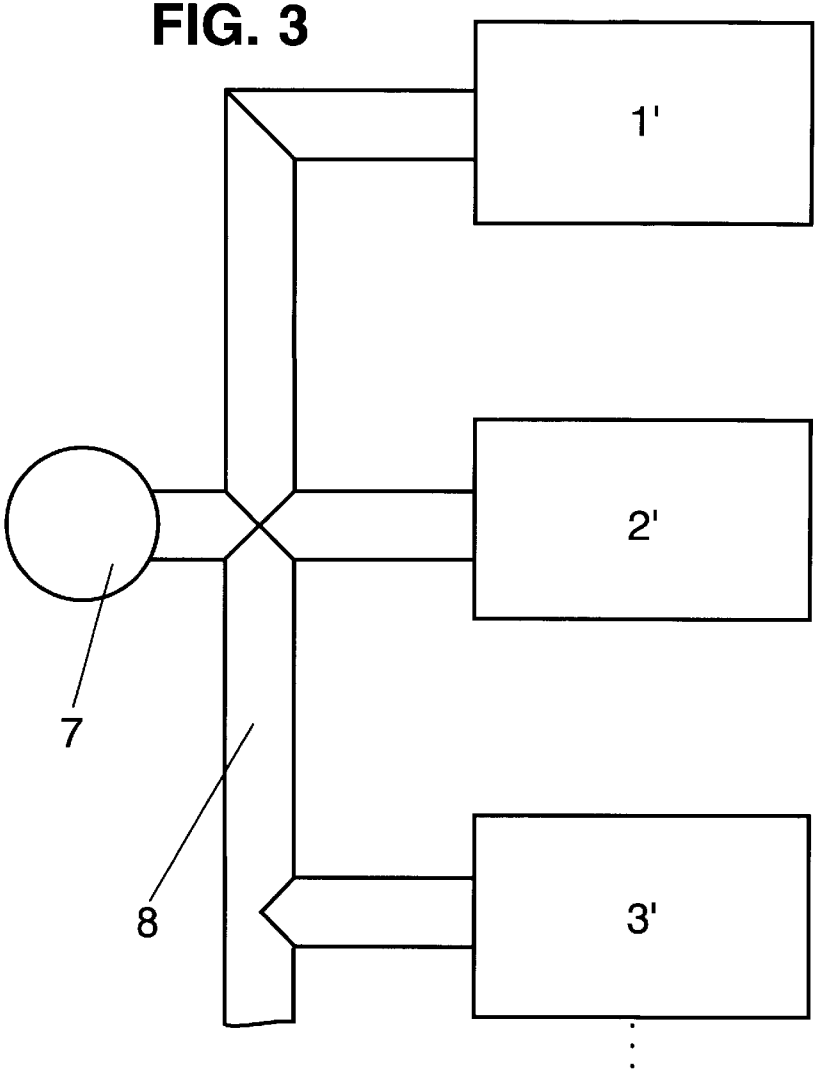
FIG. 3 is a block diagram representation of a second exemplary bus system coupling the components of a sheet-fed offset printing machine in accordance with the present invention.

FIG. 3 illustrates an exemplary embodiment of the invention wherein the angle encoder 7 comprises an absolute angle encoder. As in the above described embodiment, it is provided that the absolute angle encoder 7 forwards the angle values to the control stations 1',2',3',4',5' via the second bus 8, which is designed as a parallel bus system. The second bus 8 according to the invention for transmitting the angle position to the individual control stations 1',2',3',4' and 5' has a number of lines corresponding to the resolution capacity of the absolute angle encoder 7, it being possible to make provision that a so called zero pulse is likewise transmitted on a further line, from which zero pulse the individual control stations 1',2',3',4',5' can derive the number of single-turn revolutions of the printing machine. In the exemplary embodiment according to FIG. 3, too, the angle encoder 7 is mounted in a single-turn shaft in the first offset printing unit 2 of the sheet-fed offset printing machine.

Although shown and described are what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A control system for a sheet offset printing machine with a plurality of functional units having sheets processed therein, in which switching processes in the functional units are triggered in synchronization with a course of a sheet through the functional units of the machine, the control system comprising: at least one control station assigned to each functional unit; at least one of the control stations responsive to a sheet monitor for determining the presence and proper alignment of sheets to be printed and generating a switching command, wherein a value of the switching command represents an error event; each of the control stations connected to one another by a message-oriented protocol bus for transmitting the switching command to each of the other control stations; each control station continuously receiving a signal sensed by a sensor corresponding to an angle position of at least one rotating part of a particular functional unit; each control station storing executable switching processes related to the value of the switching command and the angle position, wherein the switching processes can be an error process or an intended function of the functional unit and wherein substantially simultaneously some of the remaining control stations, in response to receiving the switching command, execute the error process while the other control stations continue to execute their intended function.

2. The control system for a printing machine according to claim 1, further comprising a plurality of sensors for the recovery of a signal corresponding to the angular position of at least one rotating part of each functional unit.

3. The control system for a printing machine according to claim 1, wherein the sensor comprises a one-revolution revolving angle encoder and the signals from the angle encoder are feedable over a second bus to the control stations of the other units.

4. The control system for a printing machine according to claim 3, wherein the angle encoder is mounted on the unit representing the first printing mechanism of the printing machine.

5. The control system for a printing machine according to claim 1, wherein the signal from the sensor is feedable over a second bus to the control stations of the other units.

6. The control system for a printing machine according to claim 1, wherein one of the functional units is a first printing unit and the sensor is mounted to a single turn shaft in the first printing unit.

7. The control system for a printing machine according to claim 6, wherein the sensor comprises an incremental angle encoder.

8. The control system for a printing machine according to claim 6, wherein the sensor comprises an absolute angle encoder.

9. The control system for a printing machine according to claim 6, wherein the sensor comprises means for outputting a zero impulse signal upon completion of each full revolution of the single turn shaft.

10. The control system for a printing machine according to claim 5, wherein the second bus comprises a parallel bus system.

11. The control system for a printing machine according to claim 5, wherein the second bus comprises a serial bus system.

12. The control system for a printing machine according to claim 11, wherein the sensor includes means for outputting an absolute angle value and thereafter incremental angle values over the second bus.

* * * * *